US012569742B2

(12) United States Patent
Loane

(10) Patent No.: US 12,569,742 B2
(45) Date of Patent: Mar. 10, 2026

(54) SKI EXERCISING APPARATUS

(71) Applicant: 1441 HOLDINGS, INC., Salt Lake, UT (US)

(72) Inventor: R. Joel Loane, Park City, UT (US)

(73) Assignee: 1441 HOLDINGS, INC., Salt Lake, UT (US)

( * ) Notice: Subject to any disclaimer, the term of this patent is extended or adjusted under 35 U.S.C. 154(b) by 101 days.

(21) Appl. No.: 18/809,955

(22) Filed: Aug. 20, 2024

(65) Prior Publication Data

US 2024/0408470 A1 Dec. 12, 2024

Related U.S. Application Data

(60) Division of application No. 17/795,459, filed as application No. PCT/US2020/058706 on Nov. 3, 2020, now Pat. No. 12,076,628, which is a continuation of application No. 16/778,131, filed on Jan. 31, 2020, now Pat. No. 10,806,985.

(51) Int. Cl.
*A63B 69/18* (2006.01)
*A63B 22/20* (2006.01)

(52) U.S. Cl.
CPC ..... *A63B 69/18* (2013.01); *A63B 22/201* (2013.01); *A63B 2022/206* (2013.01); *A63B 2244/19* (2013.01)

(58) Field of Classification Search
CPC ..... A63B 22/201; A63B 2022/206; A63B 2244/19; A63B 69/18–182; A63B 69/0022; A63B 69/187; A63B 2069/185; A63B 23/0417; A63B 21/4041–4047; A63B 23/04
See application file for complete search history.

(56) References Cited

U.S. PATENT DOCUMENTS 3,524,641 A * 8/1970 Ossenkop ..... A63B 69/18 482/71
3,547,434 A * 12/1970 Ossenkop ..... A63B 69/18 482/71
4,743,014 A * 5/1988 Loane ..... A63B 69/18 482/130
5,020,793 A * 6/1991 Loane ..... A63B 69/18 482/129
5,147,257 A * 9/1992 Loane ..... A63B 69/18 482/80
5,429,567 A * 7/1995 Gerschefske ..... A63B 21/023 482/70
6,569,064 B1 * 5/2003 Loane ..... A63B 22/16 482/146
7,090,621 B2 * 8/2006 Loane ..... A63B 69/18 482/71

(Continued)

*Primary Examiner* — Andrew S Lo
(74) *Attorney, Agent, or Firm* — Donald R. Boys; Central Coast Patent Agengy LLC

(57) ABSTRACT

A ski exercising apparatus has a rigid frame with a set of two parallel, arcuate rails, a wheeled carriage riding on the rails, a set of two articulated footpads mounted side-by-side on the wheeled carriage, and two sets of powerbands arranged parallel with a lengthwise centerline of the apparatus, spaced apart by at least one-half of the width of the apparatus, the powerbands exerting force on the wheeled carriage to center the carriage on the arcuate rails.

10 Claims, 13 Drawing Sheets

(56) References Cited

U.S. PATENT DOCUMENTS

| | | | | |
|---|---|---|---|---|
| 7,803,091 | B2 * | 9/2010 | Loane | A63B 69/18 482/70 |
| 9,186,543 | B2 * | 11/2015 | Loane | A63B 23/04 |
| 9,339,687 | B2 * | 5/2016 | Loane | A63B 21/0557 |
| 2004/0014569 | A1 * | 1/2004 | Loane | A63B 21/0552 482/70 |
| 2006/0211544 | A1 * | 9/2006 | Loane | A63B 21/0552 482/70 |
| 2006/0223681 | A1 * | 10/2006 | Loane | A63B 22/205 482/71 |
| 2015/0119204 | A1 * | 4/2015 | Loane | A63B 21/00069 482/71 |
| 2016/0067544 | A1 * | 3/2016 | Loane | A63B 21/4045 482/71 |

* cited by examiner

SKI EXERCISING APPARATUS

CROSS-REFERENCE TO RELATED APPLICATIONS

The instant application is a divisional application of co-pending application U.S. Ser. No. 17/795,459 filed Jul. 26, 2022, which entered the US from PCT/US2020/058706 and was filed with priority from original U.S. application Ser. No. 16/778,131 filed Jan. 31, 2020. The present application thus claims priority to the filing date of U.S. Ser. No. 16/778,131 filed Jan. 31, 2020.

BACKGROUND OF THE INVENTION

1. Field of the Invention

The present invention is in the technical area of exercising apparatus and pertains more particularly to apparatus for training such as slalom skiers.

2. Description of Related Art

Ski exercising apparatus in the technical area of the present invention is well-known in the art, and numerous patents are issued to the present inventor for such apparatus. For example, U.S. Pat. No. 7,090,621 issued Aug. 15, 2006 to R. Joel Loane of Park City Utah.

A review of U.S. Pat. No. 7,090,621 shows that apparatus of this sort generally comprises a wheeled carriage riding on a pair of arcuate rails, such that the carriage may roll side-to-side on the rails, constrained by a set of rubber belts often called power bands. In this apparatus and others, a plurality of power bands is nested one within another and attached and positioned to act along a centerline of the carriage. A user stands on swinging foot pads mounted on the carriage and simulates skiing action with side-to-side movements. The power bands provide resistance to movement and force against which the user contends.

The apparatus of the referenced patent has been a standard in the industry for a decade or more, but the inventor now has made a series of improvements that provide an apparatus that more closely simulates skiing and is also safer to operate.

BRIEF SUMMARY OF THE INVENTION

A ski exercising apparatus has a set of two parallel, arcuate rails joined to first and second end tubes at a base level, forming a part of a rigid frame structure having a width, a length, a height above the base level and a lengthwise centerline, the rails providing a track rising from each end at the end tubes to a maximum height at a center of the length, a center frame element having a bottom plane across the width at the base level and sides joined to and supporting each of the arcuate rails, a first flat belt guide joined to the first end tube and to the bottom plane of the center frame element, a second flat belt guide joined to the bottom plane of the center frame element and to the second end tube, the first and second flat belt guides forming a first lengthwise guide track from end to end of the apparatus on one side of the lengthwise centerline, a third flat belt guide joined to the first end tube and to the bottom plane of the center frame element, a fourth flat belt guide joined to the bottom plane of the center frame element and to the second end tube, the third and fourth flat belt guides forming a second lengthwise guide track from end to end of the apparatus on a second side of the lengthwise centerline, a wheeled carriage riding on the track, such that the carriage, in side-to-side movement along the track rises to a maximum height at the center of the track, and descends from the center to each side, a set of two articulated footpads mounted side-by-side on the wheeled carriage, a first and a second powerband, being a first powerband set, constrained in the first lengthwise guide track, the first powerband clamped under the wheeled carriage on a first side, and the second powerband clamped under the wheeled carriage on a second, opposite side, the first and second powerbands exerting force urging the wheeled carriage toward center as the wheeled carriage is moved from the center of the track, and a third and a fourth powerband, being a second powerband set, constrained in the second lengthwise guide track, positioned parallel to the centerline of the frame structure and offset from the centerline by a distance at least one-quarter of the width of the frame structure to a second side of the centerline, the third powerband clamped under the wheeled carriage on the first side, and the fourth powerband clamped under the wheeled carriage on the second, opposite side, the third and fourth powerbands exerting force urging the wheeled carriage toward center as the wheeled carriage is moved from the center of the track, characterized in that the first and the second power band sets are parallel, spaced apart by at least one-half the width of the frame structure, and are equidistant from the centerline.

In one embodiment, in each powerband set, one powerband, clamped under the wheeled carriage on the first side, extends downward to a first set of guide rollers near the first end tube, passes over and under the rollers, extends back along the length of the frame structure, and is clamped near the second end tube, and the other powerband, clamped under the wheeled carriage on the second side, extends downward to a second set of guide rollers near the second end tube, passes over and under the rollers, extends back along the length of the frame structure, and is clamped near the first end tube. Also, in one embodiment the powerbands each have a thickness of from one-quarter to one-half inches, a width of from one and three-quarters inches to two and one-quarter inches and are formed of a mixture of natural and synthetic rubber. In one embodiment the arcuate rails have a smooth curvature over the center height of the rails and have a straight region on each end. And in one embodiment the apparatus further comprises a safety power band clamped at both ends at center of the length at the planar base, and passing over a first roller anchored to the frame at the planar base to one side of center, and over a second roller anchored to the frame at the planar base to an opposite side of center, and over a roller anchored under the wheeled carriage at center.

In one embodiment the apparatus further comprises a belt guide at the level of the planar base, extending to each side of center, with an adjustable roller bracket clamped in the belt guide on each side, carrying one of the rollers. Also, in one embodiment the adjustable roller brackets are translatable in the belt guides and are enabled to be clamped at incremental positions in the belt guides, thereby adjusting the force effect of the safety power band. In one embodiment the arcuate rails exhibit an upward-facing concave channel, and the wheels of the wheeled carriage engage the concave channels. In one embodiment the apparatus further comprises a first and a second carriage frame, each mounted on an adjustable platform mounted on a single translation track, such that the adjustable platforms may be incrementally positioned at different points along the translation track, changing the spacing of the adjustable platforms. And in one embodiment the carriage frames comprise elevated ends, further comprising foot pads each having a horizontal surface for engaging a user's foot at a first height, suspended from pivot points near an upper extremity of each of the elevated ends at a second height substantially above the first height.

DETAILED DESCRIPTION OF THE INVENTION

Figure 1A:
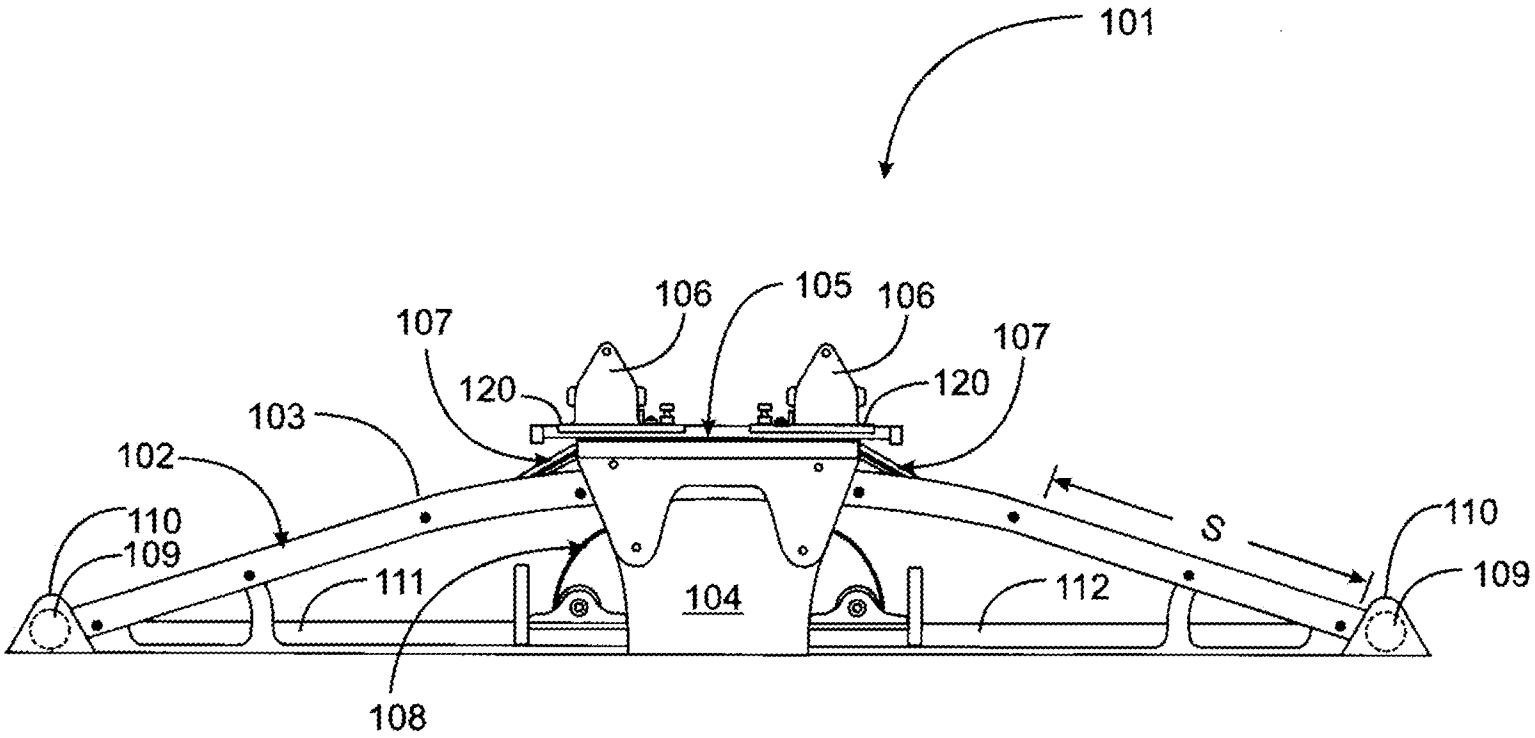
FIG. 1A is a side elevation view of an apparatus in an embodiment of the present invention.

FIG. 1A is a side elevation view of an assembled ski exercising apparatus 101 in an embodiment of the present invention. Apparatus 101 comprises a frame 102 that has concave arcuate rails 103 that are welded in this example to end tubes 109 at opposite ends of the apparatus. Arcuate rails 103 are curved in a mirror image to each side between end tubes 109, peaking in height at a center point between the end tubes, and declining in height to each side of center to a lowest height at the end tubes. The shape of the arcuate rails in a region over the center is a continuous curve. In some embodiments the arcuate rails have straight sections on each side indicated in FIG. 1A as region "S".

Belt guides 111 and 112 also weld to the end tubes, and to a center frame element 104 that also supports rails 103. Rails 103, end tubes 109 belt guides 111 and 112, and center element 104, all welded together in this example provide a sturdy frame for the apparatus. Belt guides 111 and 112 also comprise brackets for mounting rollers that serve as power belt guides. End tubes 109 are supported by molded feet 110 at the four corners of the assembled apparatus, providing a slide-resistant, sturdy basis for the exercise apparatus.

In this example a wheeled carriage 105, upon which an upper carriage frame 106 for suspended foot pads is mounted, rides on the wheels of the wheeled carriage in concave channels in the arcuate rails 103. The concave channels are shown and described below with reference to FIG. 2B. Carriage 105 may move side-to-side on the arcuate rails constrained by sets of power bands 107 that are anchored under carriage 105, extending to each side, passing through roller sets not shown in this view but described in following views and description, and extending the full length of the apparatus to anchor again at an opposite end of the frame. As carriage 105 is urged by a user to one side the power bands exert an escalating force to return the carriage toward the center. A safety belt arrangement comprising adjustable roller carriages and a safety belt 108 anchored under the carriage, provides additional force constraining carriage 105.

Figure 1B:
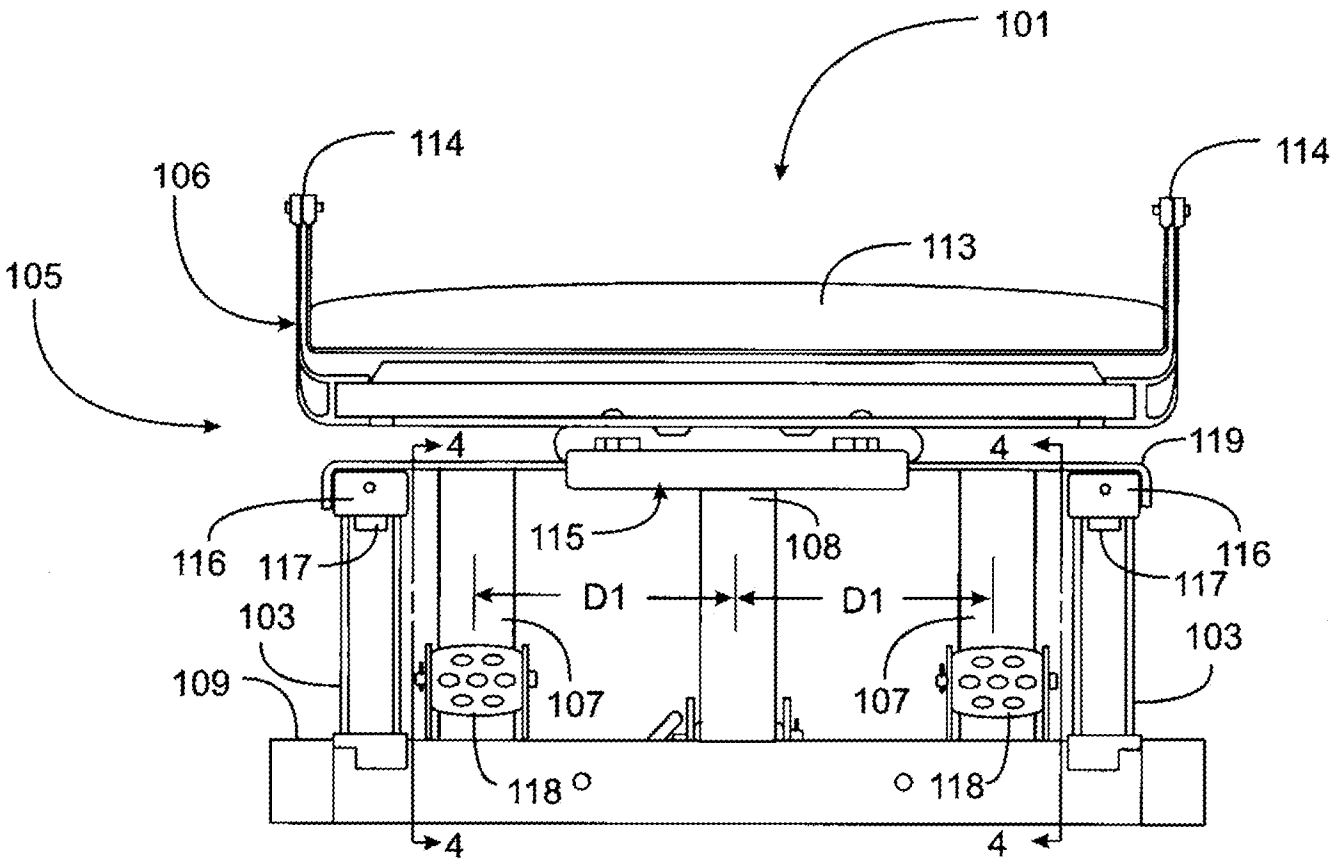
FIG. 1B is an end elevation view of the assembled ski exercising apparatus of FIG. 1A.

FIG. 1B is an end elevation view of the assembled ski exercising apparatus 101 of FIG. 1A. This view shows the substantial width of the apparatus, which is considerably wider than conventional apparatus in the art. For example, the spacing between the parallel rails in the apparatus taught in U.S. Pat. No. 7,090,621, mentioned above in the Background section, is about nine inches. In the present invention the spacing between the parallel rails is nearly fourteen inches, an increase of about thirty-five percent. This unusual width, unique in the art, provides extraordinary stability for the apparatus in use. Further, the two sets of power bands in the present invention, as opposed to one set on the conventional art, shown spaced apart a common dimension DI from center of the apparatus, provide substantially more adjustability of the apparatus for users of different mass and different use procedures. For example, a large skier weighing 250 pounds and very active athletically might engage the apparatus much more vigorously and with greater recurring forces than a user weighing perhaps 160 pounds, that is not so athletically inclined.

The double set of power bands, which is new in the art, with each set comprising two power bands engaged in a unique manner described in enabling detail below, allows the apparatus to be configured to be an optimum experience for all users, regardless of size and activity level.

More detail of carriage 105 is evident in FIG. 1B as well. Carriage 105 comprises a lower frame 119 under which wheel pods 116 are securely mounted, and each wheel pod 116 carries a polymer wheel 117 that rides in a channel of rails 103. There are four pods 116 with wheels 117, one at each of four corners of lower carriage frame 119. Upper carriage frame 106 mounts to lower carriage frame 119 on a translation track 115 whereby the stance of the footpads may be adjusted along the length of the apparatus. Persons of different height and weight need different spacing (stance) between the footpads. Footpads 113 are suspended from upper carriage frame 106 at pivot points 114 above a plane where the user's feet contact the footpads. This suspended footpad arrangement provides an action essentially the same as a user would experience on a real pair of skis.

Returning to power bands 107, one roller 118 of a pair of rollers on each side may be seen, under which power bands pass at ends of the apparatus. More detail of the power bands and rollers is provided below in enabling detail.

Figure 1C:
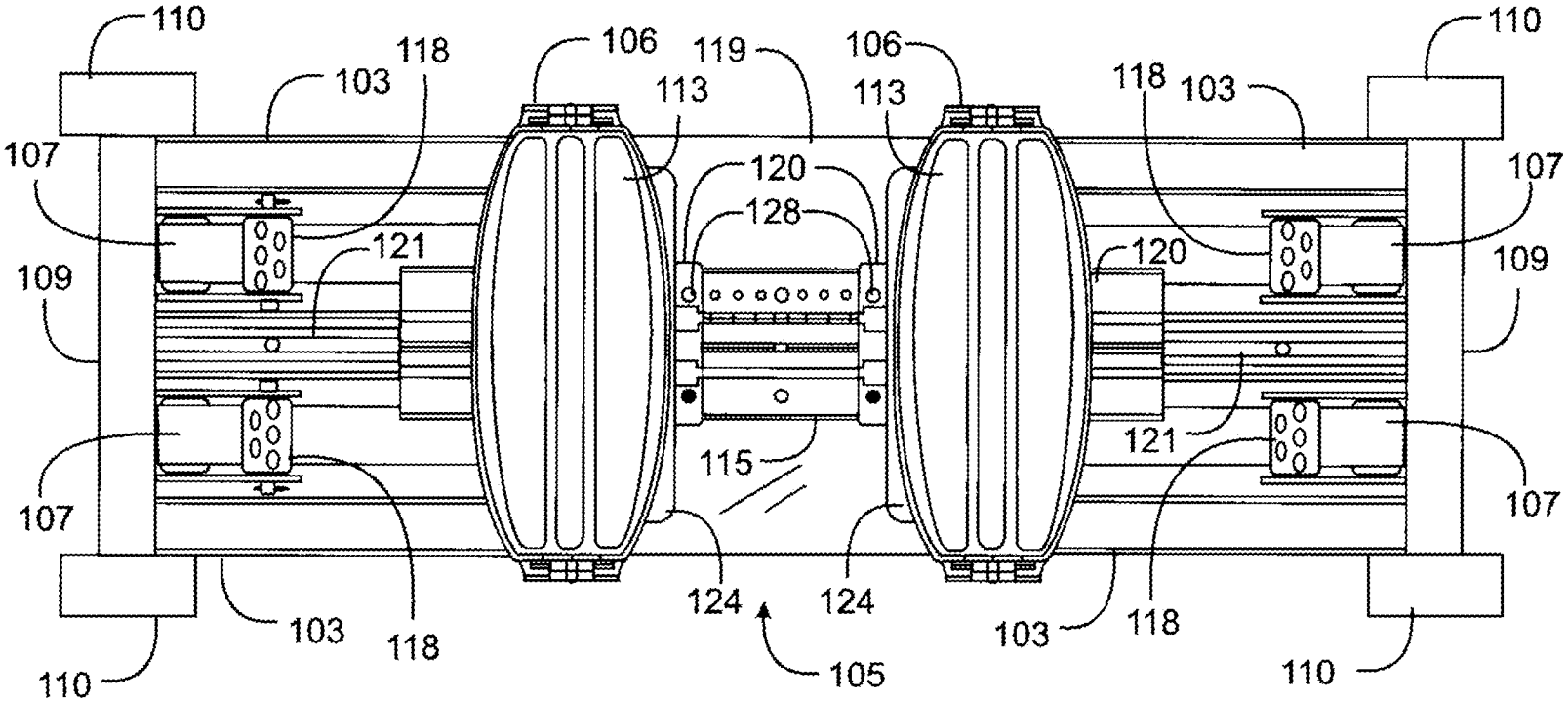
FIG. 1C is a top plan view of the apparatus of FIGS. 1A and 1B.

FIG. 1C is a top plan view of apparatus 101 of FIGS. 1A and 1B. Arcuate rails 103 may be seen as spanning between end tubes 109, which are carried on molded feet 110. Carriage 105 is shown engaged with arcuate rails 103 and may ride left and right on the rails, constrained by power bands 107 and a center safety band, not seen in FIG. 1C. Lower frame 119 of the carriage supports translation track 115 upon which adjustable platforms 120 may be spaced apart to adjust a user's stance between foot pads 113. Other elements in FIG. 1C are described above in regard to FIGS. 1A and 1B. Also seen in FIG. 1C, but not in FIGS. 1A and 1B are tracks 121, centered on the lengthwise axis of the apparatus. These tracks are for adjustment brackets to set at different positions lengthwise to control force exerted by safety belt 108, which is described in further enabling detail below.

Figure 2A:
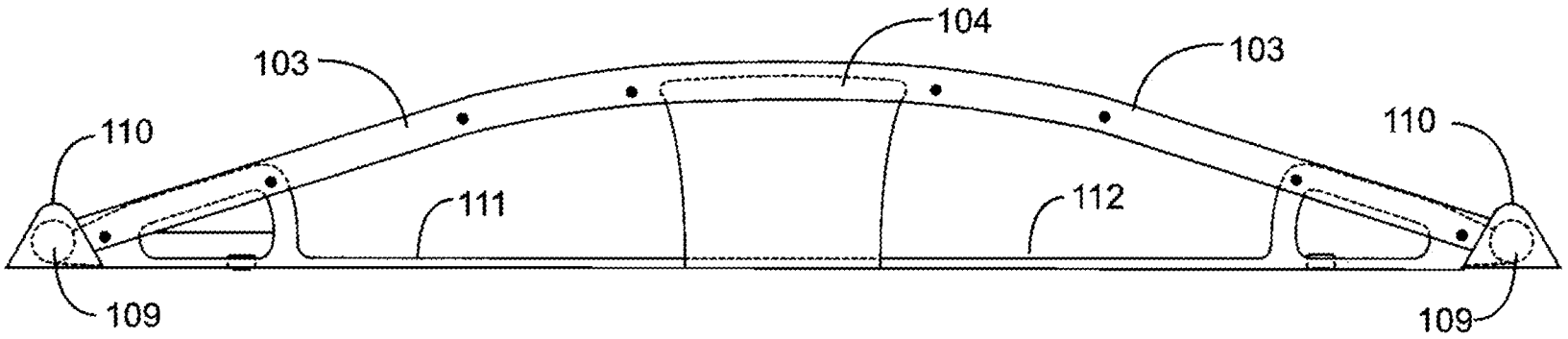
FIG. 2A is a side elevation view of elements that form a sturdy base for the apparatus in an embodiment of the invention.
Figure 2B:
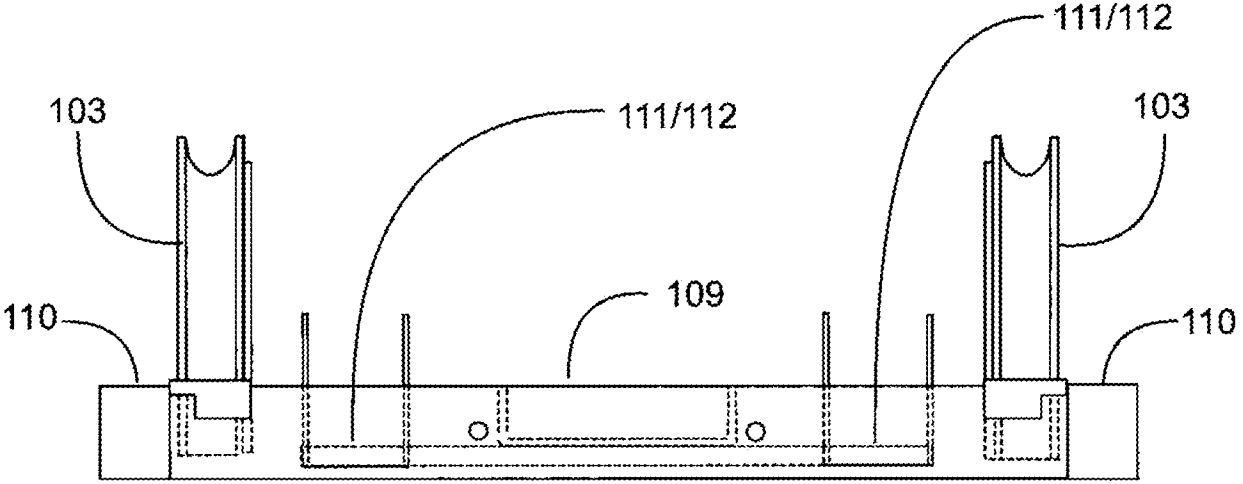
FIG. 2B is an end view of the assembly of FIG. 2A.
Figure 2C:
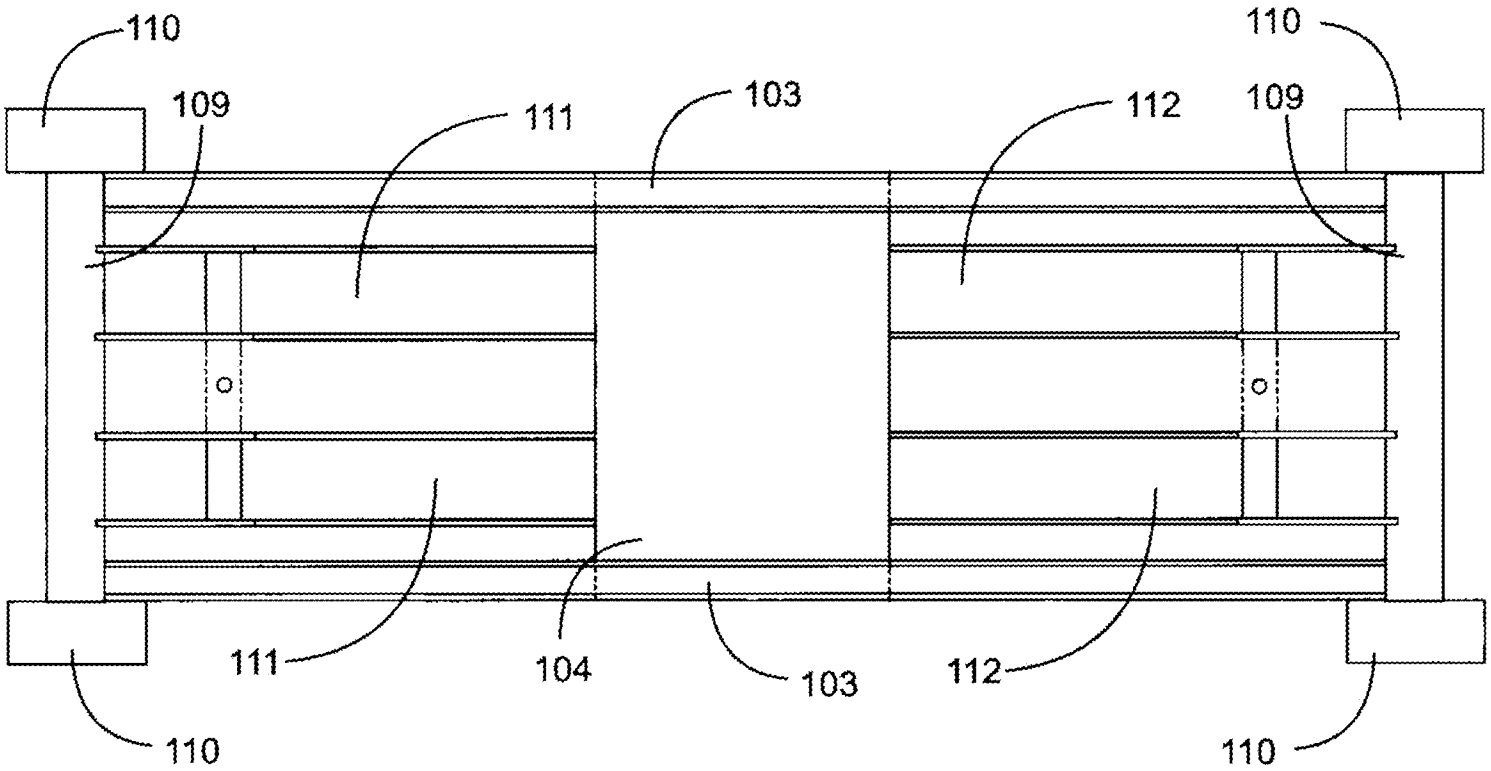
FIG. 2C is a top plan view of the assembly of FIG. 2A.

FIG. 2A is a side elevation view of essentially just framing elements that together form the base, or foundation, of the ski exercise apparatus in embodiments of the present invention. Arcuate rails 103 fasten to end tubes 109, in one embodiment by welding. Center support 104 supports the arcuate rails, and belt guides 111 and 112 weld to the end tubes 109 and also to center support 104. This construction forms the base of the apparatus. FIG. 2B is an end view of this base structure, illustrating the placement and spacing of arcuate rails 103 and the belt guides 111 and 112. The extra-wide spacing of the arcuate rails 103, and the spacing of the belt tracks, hence the two belt sets, is evident in the end view of FIG. 2B. The concave arcuate form of rails 103 is also evident in this view. FIG. 2C is a top plan view of the assembly of FIGS. 2A and 2B. The elements are numbered with the same numbers as in FIGS. 2A and 2B, and the plan view again illustrates the unique spacing of the arcuate rails and the belt tracks, hence the belts, in embodiments of the invention.

Figure 3:
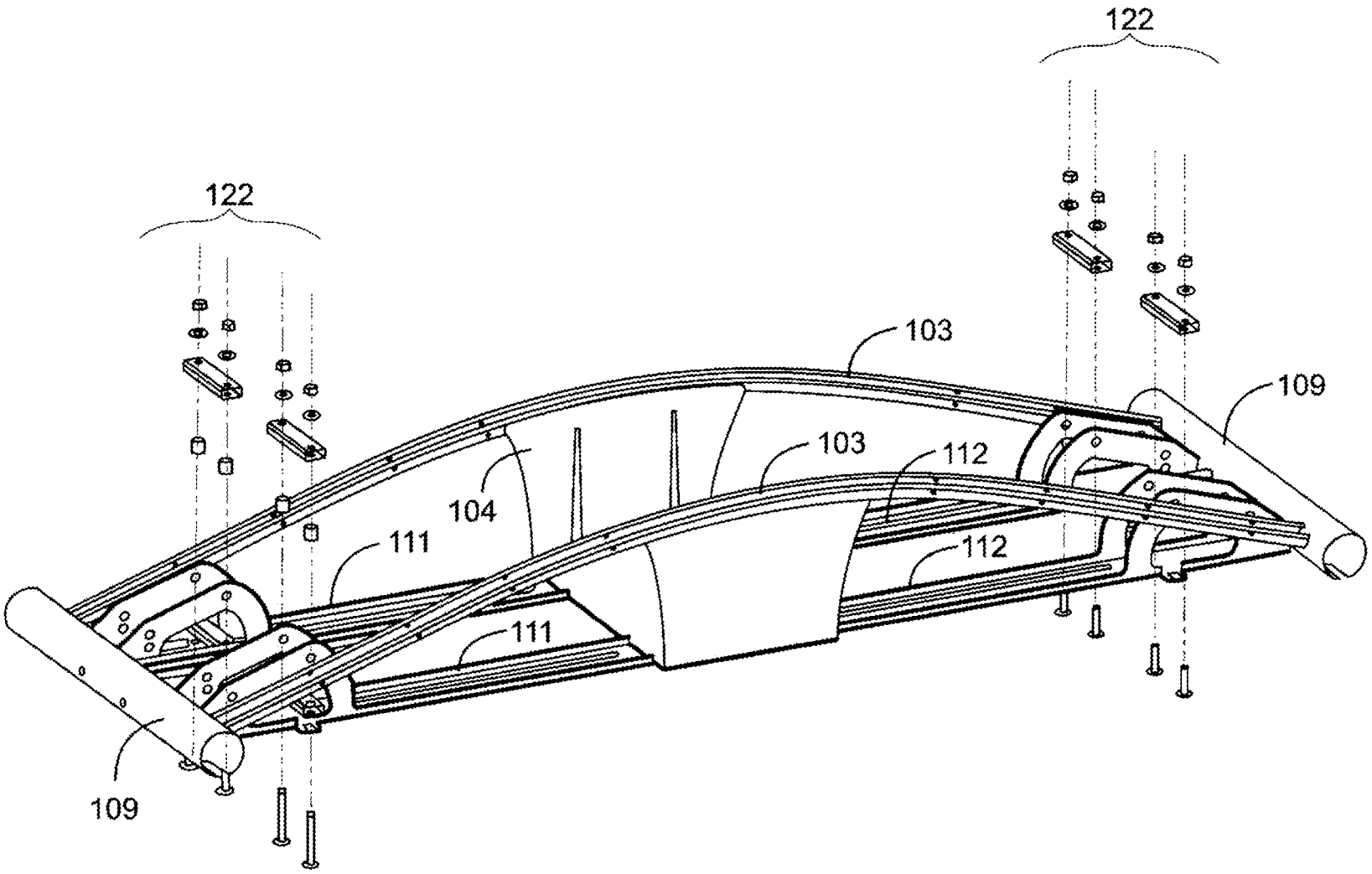
FIG. 3 is a perspective view of the assembly also shown in FIGS. 2A, 2B and 2C.

FIG. 3 is a perspective view of the assembly also shown in FIGS. 2A, 2B and 2C, to better illustrate the composition and spacing of the various elements. End tubes 109, arcuate rails 103, center support 104 and belt guides 111 and 112 are all clearly represented in FIG. 3. In addition to the elements defining a frame, sets of clamp elements 122 are shown in exploded view. These clamps are a part of each belt guide 111 and 112, in the end regions which provided brackets for belt rollers and serve to clamp belts in a unique manner described further below in enabling detail.

Figure 4:
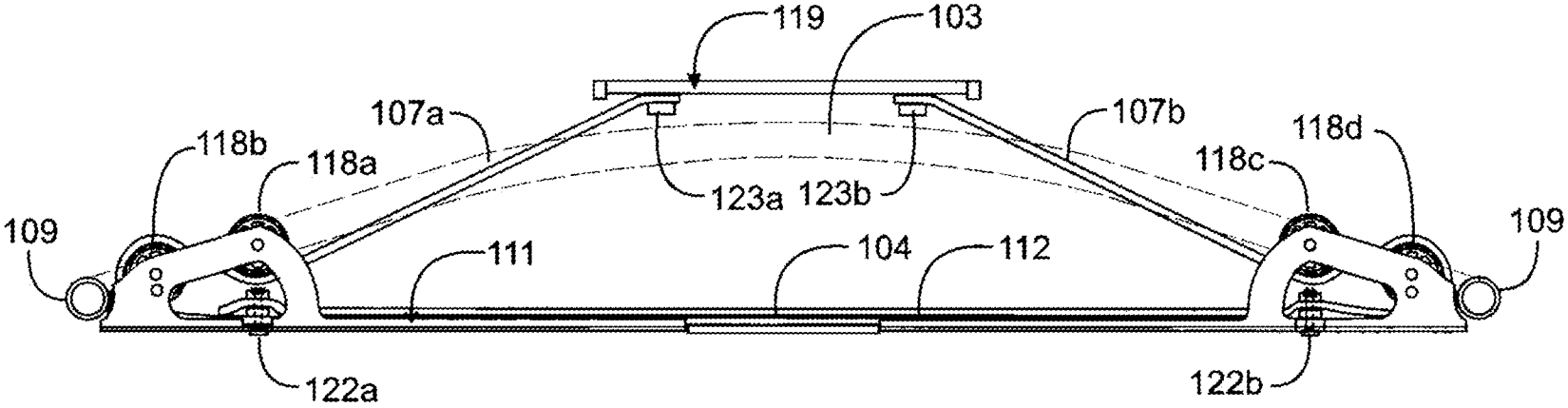
FIG. 4 is a section view taken along section line 4-4 of FIG. 1B.

Referring now to FIG. 1B, a section line 4-4 is shown on each side of the assembly. FIG. 4 is this section view, which is the same from either side, showing one set of two belts 107*a* and 107*b* and how each set of two belts is arranged and clamped to the carriage base 119 and to clamps 122*a* and 122*b* that are a part of roller brackets that are a part of belt guides 111 and 112. The section 4-4 is the same whether viewed from one side or the other side of FIG. 1B, showing the belt arrangement on either side.

Four rollers 118*a* through 118*d* are shown in FIG. 4, rollers 118*a* and 118*b* in the roller bracket that is a part of belt guide 111, and rollers 118*c* and 118*d* in the roller bracket that is a past of belt guide 112 on the opposite end of the apparatus. There are two belts, 107*a* and 107*b* in the set on one side of the apparatus. Both belts in a set have, in this example, a cross section of 8 mm thickness and 50 mm width, and are each 80 inches in length. These dimensions may well vary in different embodiments. For example, over several embodiments the thickness of powerbands may vary between one-quarter and one-half inch, and the width may vary from 1 and three-quarters inches to two and one-quarter inches. The material in one embodiment is a blend of natural and synthetic rubber. The material and blend may also vary in different embodiments.

Belt 107*a* is clamped under carriage base 119 at clamp 123*a*. The carriage base is a part of a wheeled carriage 105 (see FIG. 1) that rides on the arcuate rails 103 but is shown simply as the base in this view for sake of simplicity.

From the clamp 123*a* belt 107*a* passes under roller 118*a*, and then over roller 118*b*, and turns under roller 118*b* to extend the full length of the apparatus to clamp 122*b*, where the end of the belt is securely clamped to a portion of the bracket of belt guide 112. Belt 107*a* passes under clamp 122*a* without being clamped at that point, so the full 80-inch length of belt 107*a* extends from clamp 123*a* under the carriage past rollers 118*a* and 118*b* and all the way to clamp 122*b* and may stretch along that full length. As carriage 105, and hence carriage base 119 is urged to the right from the center position shown, belt 107*a* stretches along the full 80-inch length.

Belt 107*b* is clamped under carriage base 119 at clamp 123*b*. From the clamp 123*b* belt 107*b* passes under roller 118*c*, and then over roller 118*d*, and turns under roller 118*d* to extend the full length of the apparatus to clamp 122*a*, where the end of the belt is securely clamped to a portion of the bracket of belt guide 111. Belt 107*b* passes under clamp 122*b* without being clamped at that point, so the full 80-inch length of belt 107*b* extends from clamp 123*b* under the carriage past rollers 118*c* and 118*d* and all the way to clamp 122*a*. As carriage 105, and hence carriage base 119 is urged to the left from the center position shown, belt 107*b* stretches along the full 80-inch length.

The arrangement of the belts in the set such that each may stretch along a full 80-inch length is an important and unique feature of the apparatus that provides for a very stable returning force on carriage 105 as the carriage moves from side to side. A power band of substantially lesser length between clamped ends, which is the circumstance in the prior art, provides a force that varies in magnitude much more than the power belts in embodiments of the instant invention.

It will be apparent to the skilled person that a section taken of the belt set on the opposite side of the apparatus from the set shown in FIG. 4, will be essentially the same as the section described with reference to FIG. 4. Thusly carriage 105 is constrained in each direction from center by two sets of two 80-inch belts.

Figure 5:
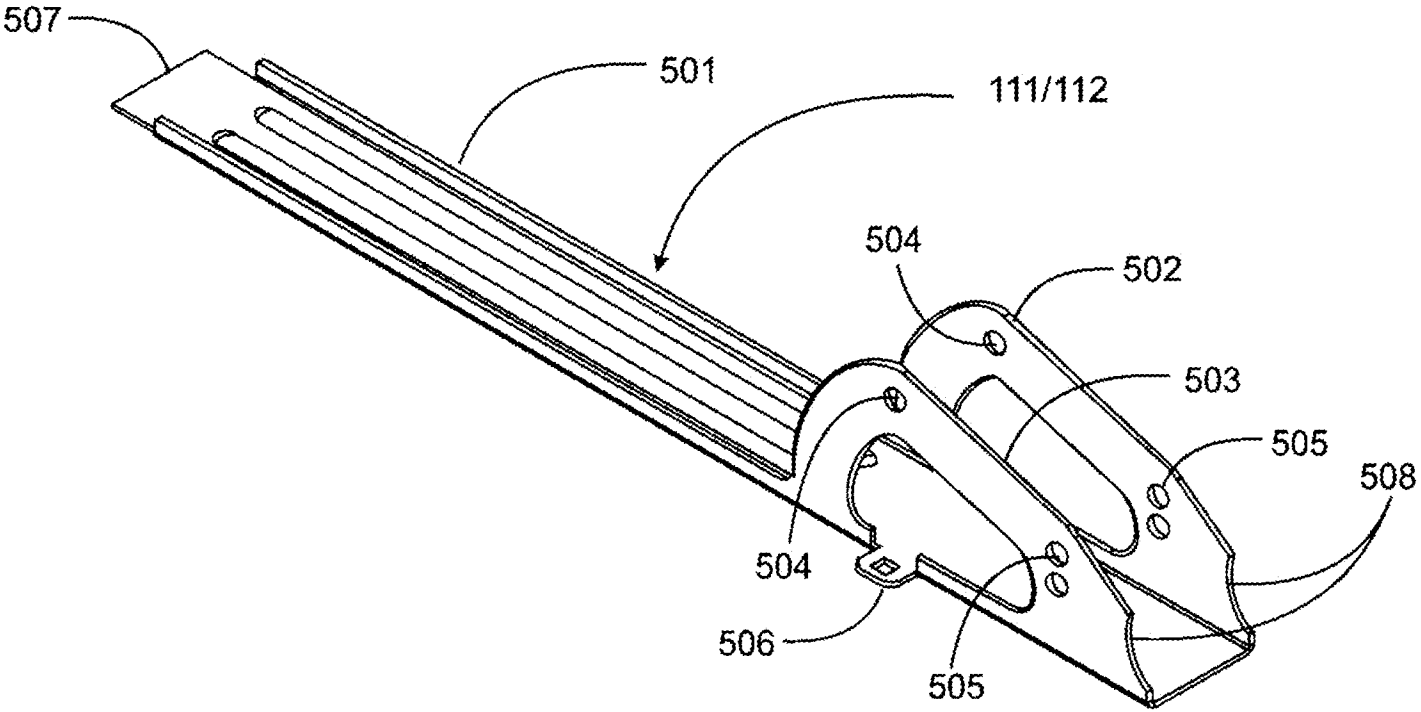
FIG. 5 is a perspective view of belt tracks in an embodiment of the invention.

FIG. 5 is a perspective view of belt guides 111/112 in an embodiment of the invention, to provide a better understanding of the structure of the apparatus of the invention. Belt guides 111 and 112 are seen in FIG. 3, where it is clear that there are four such tracks. As seen in FIG. 3, one end of each belt track is joined, such as by welding, at an inboard end to a bottom plane of the central support 104, and at an outboard end to end tube 109. As seen in FIG. 5 the belt track has a track guide length 501 which has side rails that are for restraining the belts within the belt track. Each belt track further has a bracket at one end comprising two vertically oriented portions 502 and 503, which may be formed from a flat sheet of metal also used to form portion 501. Each portion 502 and 503 has sets of holes 504 and 505 which are mounting holes for axels that hold rollers, such as rollers 118*a* through 118*d*. There is additionally a bracket 506 that serves to anchor portions of clamps, such as clamps 122*a* and 122*b* as shown in FIG. 4. End 507 joins to center support 104, for example by welding, and curves edges 508 join to end tube 109, for example by welding.

Referring again to FIG. 1A a safety belt 108 is indicated and described very briefly with reference to FIG. 1A as safety belt arrangement comprising adjustable roller carriages and a safety belt anchored under the carriage, providing in certain circumstances additional force constraining carriage 105. FIG. 1B shows safety belt 108 is arranged to act on a centerline of the exercise apparatus.

Figure 6A:
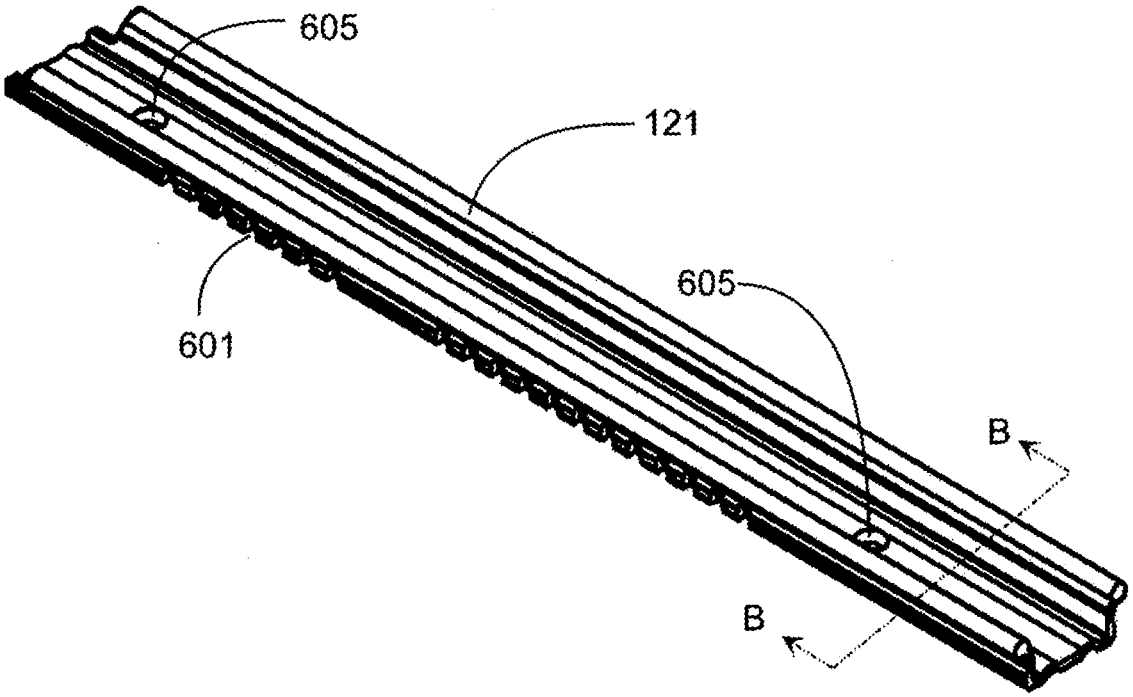
FIG. 6A is a perspective view of a roller bracket track in an embodiment of the invention.
Figure 6B:
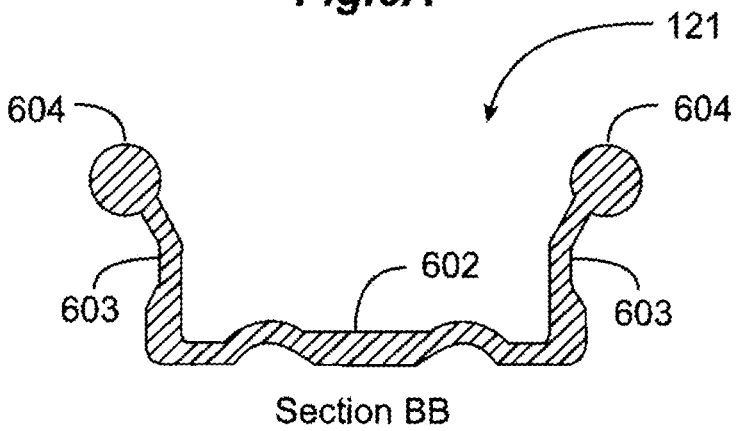
FIG. 6B is a section view through the track of FIG. 6A.

FIG. 6A is a perspective view of roller bracket track 121 in an embodiment of the invention, and FIG. 6B is a section view through track 121 of FIG. 6A. Track 121 is seen to have a base portion 602, side portions 603 and rounded upper parallel portions 604. A series of slotted openings 601 is implemented on each side of trach 121. As may be seen again in view 1C one bracket track 121 is positioned on each side along the length of the apparatus. Track 121 on each side of center is bolted through holes 605 securely to cross braces (not shown) that are a part of clamp mechanisms 122*a* and 122*b* and extend laterally between the roller brackets of belt guides 111 and 112. Bracket tracks 121 are further secured to a bottom portion of center support 104 also through holes 605.

Figure 7:
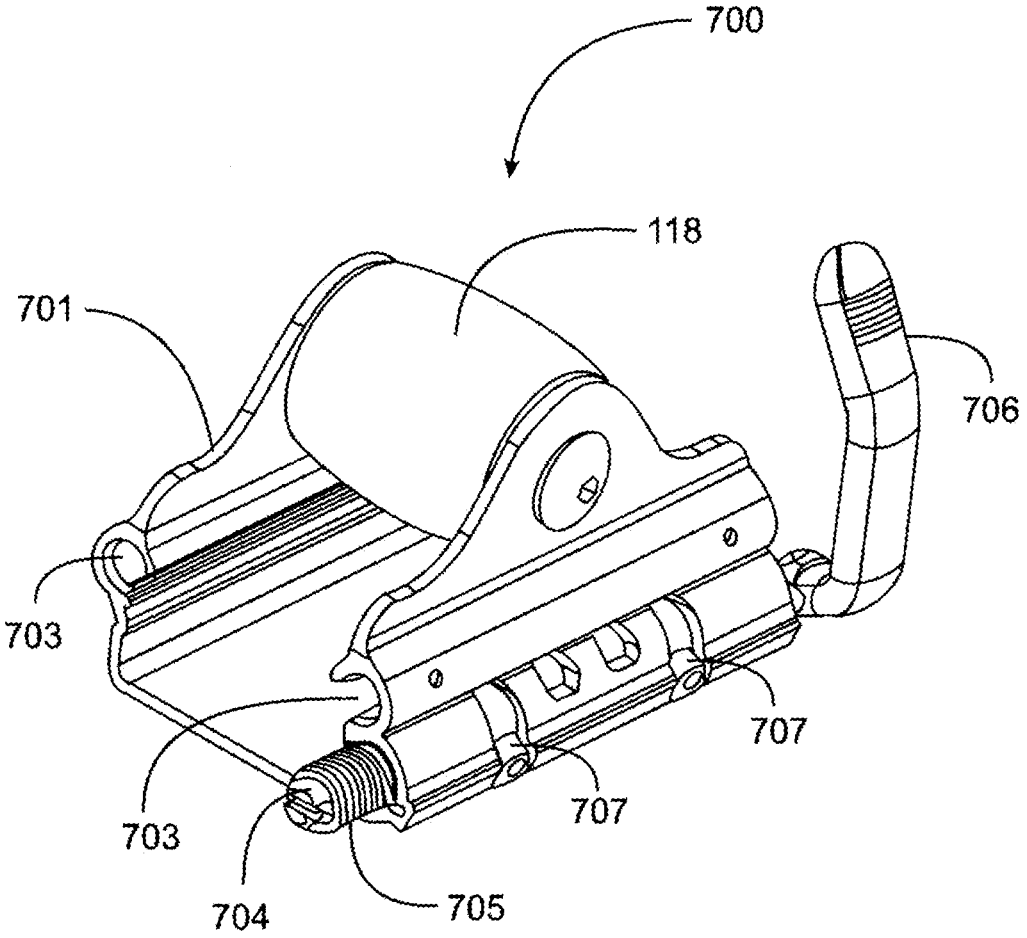
FIG. 7 is a perspective view of an adjustable roller bracket in an embodiment of the invention.

FIG. 7 is a perspective view of an adjustable roller bracket 700 in an embodiment of the invention, having a frame 701 with a belt roller 118 pivoted between sides of the roller bracket. There are parallel lengthwise channels 703 which are configured to engage parallel rails 604 of track 121. One roller bracket 700 engages track 121 on each side of center and may be incrementally positioned at different positions along the track. This arrangement is shown in a side elevation view in FIG. 8, which is a section taken through the center of the apparatus along the length. As the section is through the safety belt assembly, including the two brackets 700 and the rollers, the locking arms 706 are not shown.

Figure 8:
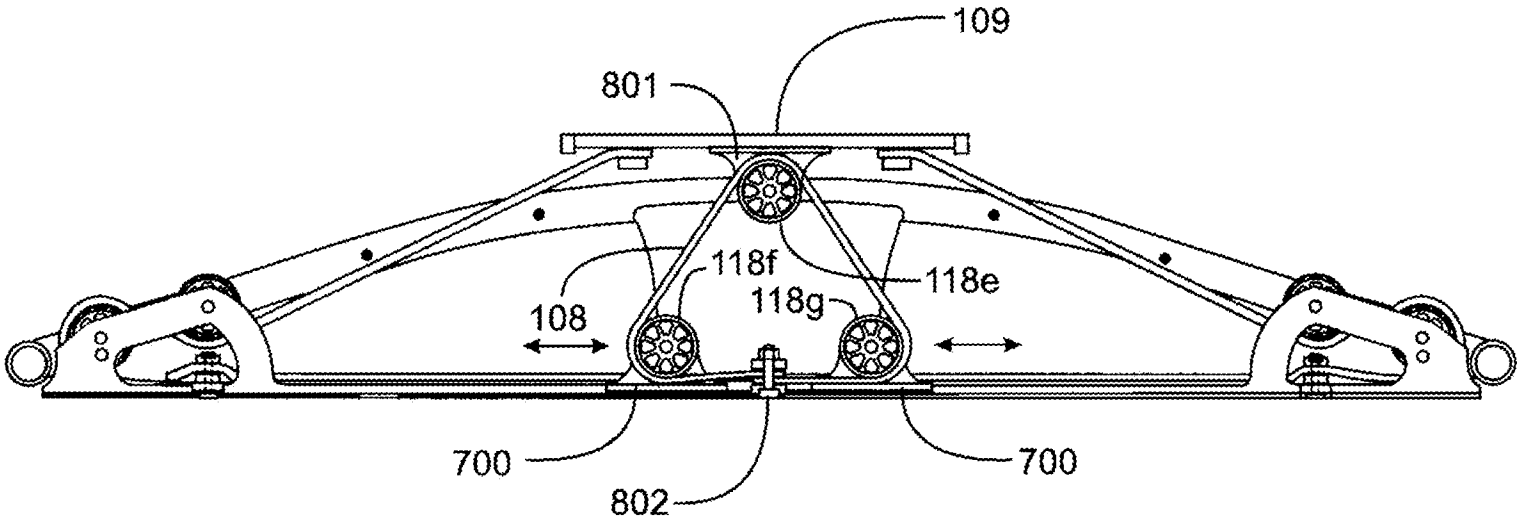
FIG. 8 is a side elevation view taken on a centerline along the length of the apparatus of FIG. 1A.

In the section view of FIG. 8 a roller bracket 801, which is fixed and stationary under carriage base 109, carries a roller 118*e*. Adjustable roller brackets 700 are shown on each side carrying rollers 118*f* and 118*g*. The track 121 is not called out in this view, but roller brackets 700 may be repositioned along that track in the direction of the horizontal arrows. Although not clearly seen in FIG. 8, the effect of the safety belt 108 is also managed by the length of the belt. The length of the belt, and the position of the roller brackets 118*f* and 118*g* determine where in the travel of the carriage, that the safety belt arrangement will exert a force on the carriage.

Figure 9:
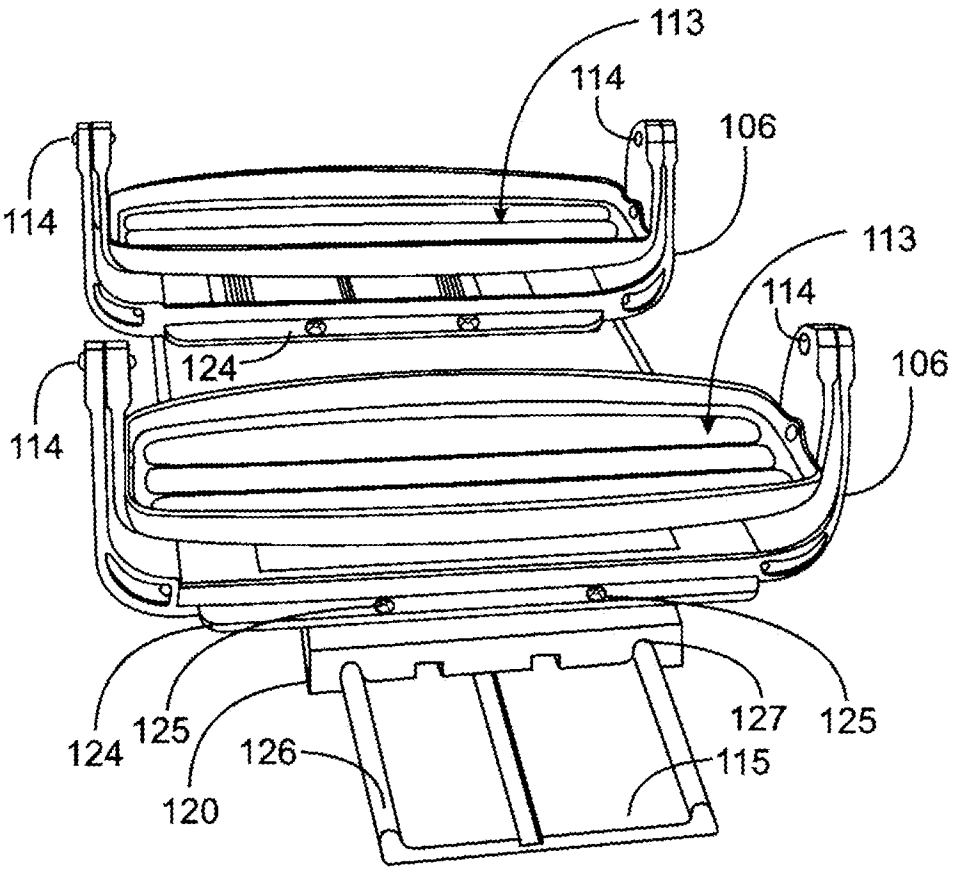
FIG. 9 is a perspective view of foot pad assemblies on a carriage in an embodiment of the invention.

FIG. 9 is a perspective view of foot pads 113 that are suspended with bearings at pivot axes 114 from upper carriage frames 106. These elements may be seen in plain view in FIG. 1C. Carriage frames 106 are mounted to plates 124 that are in turn fastened to adjustable platforms 120 by fasteners 125. Platforms 120 are mounted to translation track 115 and constrained in direction of translation by rounded ridges 126 on translation track 115 that engage matching grooves 127 in platform 120. There is, for each platform 120, a vertically oriented spring-loaded pin mounted on platform 120 enabled to engage a series of holes in translation track 115 such that each foot pad assembly may be incrementally moved along track 115 and locked into place at a desired position. The adjusting and locking pins are not seen in FIG. 9, as they are between the foot pad assemblies, but may be seen as pins 128 in FIG. 1C.

The feature of sideways translatable platforms carrying the individual foot pad assemblies enables a user to adjust the position and spacing between the foot pad assemblies on the rolling carriage to best suit the user's size, weight and stance. As the user urges wheeled carriage 105 side to side in simulating the art of, for example, slalom skiing, with the user's feet in the individual suspended foot pads, the pads swing on the pivot points 114 to present the foot pads in the relative positions the user's ski boots would assume in the actual skiing activity.

The skilled artisan will understand that the features of the ski exercising apparatus in the embodiments described above, with reference to the several views of the drawings are entirely exemplary, and that many alterations might be made in the descriptions without departing from the scope of the invention. For example, the height of the tracks may vary in different embodiments, and the width and length may vary as well, depending on application to different groups of potential users. Length and cross-section of belts may vary as well. Many other changes might be made within the scope of the invention. The invention is limited only be the claims.

The invention claimed is:

1. A ski exercising apparatus, comprising:

a set of two parallel, arcuate rails joined to first and second end tubes at a base level, forming a part of a rigid frame structure having a width, a length, a height above the base level and a lengthwise centerline, the rails providing a track rising from each end tube to a maximum height at a center of the length;

a center frame element having a bottom plane across the width at the base level and sides joined to and supporting each of the arcuate rails;

a first flat belt guide joined to the first end tube and to the bottom plane of the center frame element, a second flat belt guide joined to the bottom plane of the center frame element and to the second end tube, the first and second flat belt guides forming a first lengthwise guide track from end to end of the apparatus on one side of the lengthwise centerline;

a third flat belt guide joined to the first end tube and to the bottom plane of the center frame element, a fourth flat belt guide joined to the bottom plane of the center frame element and to the second end tube, the third and fourth flat belt guides forming a second lengthwise guide track from end to end of the apparatus on a second side of the lengthwise centerline;

a wheeled carriage riding on the track, such that the carriage, in side-to-side movement along the track rises to a maximum height at a center of the track, and descends from the center;

a set of two articulated footpads mounted side-by-side on the wheeled carriage;

a first and a second powerband, being a first powerband set, constrained in the first lengthwise guide track, the first powerband clamped under the wheeled carriage on a first side, and the second powerband clamped under the wheeled carriage on a second, opposite side, the first and second powerbands exerting force urging the wheeled carriage toward the center of the track as the wheeled carriage is moved from the center of the track; and a third and a fourth powerband, being a second powerband set, constrained in the second lengthwise guide track, positioned parallel to the centerline of the frame structure and offset from the centerline by a distance at least one-quarter of the width of the frame structure to a second side of the centerline, the third powerband clamped under the wheeled carriage on the first side, and the fourth powerband clamped under the wheeled carriage on the second, opposite side, the third and fourth powerbands exerting force urging the wheeled carriage toward the center of the track as the wheeled carriage is moved from the center of the track;

characterized in that the first and the second powerband sets are parallel, spaced apart by at least one-half the width of the frame structure, and are equidistant from the centerline.

2. The ski exercising apparatus of claim 1 wherein, in each powerband set, one powerband, clamped under the wheeled carriage on the first side, extends downward to a first set of guide rollers near the first end tube, passes over and under rollers in the first set of guide rollers, extends back along the length of the frame structure, and is clamped near the second end tube, and the other powerband, clamped under the wheeled carriage on the second side, extends downward to a second set of guide rollers near the second end tube, passes over and under rollers in the second set of guide rollers, extends back along the length of the frame structure, and is clamped near the first end tube.

3. The ski exercising apparatus of claim 1, wherein the powerbands each have a thickness of from one-quarter to one-half inches, a width of from one and three-quarters inches to two and one-quarter inches and are formed of a mixture of natural and synthetic rubber.

4. The ski exercising apparatus of claim 1, wherein the arcuate rails have a smooth curvature over the center height of the rails and have a straight region on each end.

5. The ski exercising apparatus of claim 1, further comprising a safety power band clamped at both ends at center of the length, and passing over a first roller anchored to the frame structure to one side of center, and over a second roller anchored to the frame structure to an opposite side of center, and over a roller anchored under the wheeled carriage at center.

6. The ski exercising apparatus of claim 5, further comprising a belt guide, extending to each side of center, with an adjustable roller bracket clamped in the belt guide on each side, carrying one of the rollers.

7. The ski exercising apparatus of claim 6, wherein the adjustable roller brackets are translatable in the belt guides and are enabled to be clamped at incremental positions in the belt guides, thereby adjusting the force effect of the safety power band.

8. The ski exercising apparatus of claim 1, wherein the arcuate rails each exhibit an upward-facing concave channel, and wheels of the wheeled carriage engage the concave channels.

9. The ski exercising apparatus of claim 1 further comprising a first carriage frame mounted on a first platform and a second carriage frame mounted on a second platform, the first and second platforms adjustable along a single translation track, such that the platforms may be incrementally positioned at different positions along the translation track, changing the spacing between the carriage frames.

10. The ski exercising apparatus of claim 9, wherein the carriage frames comprise elevated ends, further comprising foot pads each having a horizontal surface for engaging a user's foot at a first height, suspended from pivot points near an upper extremity of each of the elevated ends at a second height substantially above the first height.

* * * * *